United States Patent [19]

Blumenberg

[11] 4,082,977

[45] Apr. 4, 1978

[54] ELECTRON GUN FOR CATHODE RAY TUBE DETACHABLE FROM BASE SUPPORT

[75] Inventor: Horst H. Blumenberg, Elmwood Park, Ill.

[73] Assignee: Zenith Radio Corporation, Glenview, Ill.

[21] Appl. No.: 689,611

[22] Filed: May 24, 1976

[51] Int. Cl.[2] ..... H01J 29/02; H01J 29/82

[52] U.S. Cl. ..... 313/457; 313/417

[58] Field of Search ..... 313/451, 456, 457, 417, 313/482, 441, 446, 449, 409, 318, 444, 447, 448, 411

[56] References Cited

U.S. PATENT DOCUMENTS

| | | | |
|---|---|---|---|
| 2,139,678 | 12/1938 | Glass | 313/449 |
| 2,413,267 | 12/1946 | Trumbull et al. | 313/451 |
| 2,941,101 | 6/1960 | Sherman | 313/411 |
| 3,213,310 | 10/1965 | Douglass et al. | 313/451 |
| 3,387,166 | 6/1968 | Kraner et al. | 313/417 X |
| 3,529,196 | 9/1970 | Bell | 313/456 |
| 3,716,739 | 2/1973 | Say | 313/451 |
| 3,771,002 | 11/1973 | Standaart | 313/411 |

FOREIGN PATENT DOCUMENTS

| | | | |
|---|---|---|---|
| 651,518 | 4/1951 | United Kingdom | 313/446 |

*Primary Examiner*—Robert Segal
*Attorney, Agent, or Firm*—Ralph E. Clarke

[57] ABSTRACT

This disclosure depicts a quick-mount electron gun mounting means for use in a television cathode ray tube. The tube has a neck terminated by a base and includes adjacent to the base an electron gun support plate rigidly supported closely adjacent to the base by lead-in pins. The quick-mount gun mounting means include male-female socket components, with said gun having one socket component including means embedded in at least one of said beads, the plate having means defining the other socket component. The socket components provide for facile and secure plugging together of the gun and the base. The combination includes electrically conductive means connected between at least one of the lead-in pins and one of the gun electrodes. The male-female socket components provide also for the facile and secure plugging together of electrically conductive paths to transmit electrical voltages or currents between the lead-in pins and the gun electrodes.

1 Claim, 9 Drawing Figures

ELECTRON GUN FOR CATHODE RAY TUBE DETACHABLE FROM BASE SUPPORT

CROSS REFERENCE TO RELATED APPLICATION

This application relates to, but is in no way dependent upon copending application of common ownership herewith, including: Ser. No. 642,049, filed Dec. 18, 1975 (now U.S. Pat. No. 4,032,811)

BACKGROUND OF THE INVENTION

This invention is directed to an improved electron gun support structure for guns used in television cathode ray tubes.

Electron guns for television cathode ray tubes generate one or more beams of electrons by cathodic thermionic emission. The resulting beams are formed and shaped by a tandem succession of electrodes spaced along the central axis of the gun. The electrodes are commonly supported by a plurality of elongated, axially oriented structural beads, or "pillars", of glass. The electrodes cause the beams to be focused on electroluminescent phosphors located on the inside of the faceplate of the cathode ray tube. In the context of today's television systems, electron guns for television cathode ray tubes may be the single-beam type for black-and-white or index-type color television picture tubes, or, they may be of the three-beam, in-line type or the three-beam, delta-type for color picture tubes.

It is essential to the proper performance of an electron gun that the gun, as installed in the neck of the cathode ray tube envelope, be in proper alignment with the center axis of the tube, which in turn perpendicularly intersects the faceplate, typically rectangular, at the intersection of the major and minor axes thereof. Also, the gun must be installed in rotational alignment with the (horizontal) planes in which the beams are scanned. And when once installed, the gun must remain in proper alignment and be immune to the dynamic forces resulting from thermal cycling associated with sporadic tube operations, as well as to forces produced by shock and vibration. Any gun misalignment is symptomized in color tubes, depending upon the type of tube, by effects such as color impurity and color fringing, lack of resolution, improper gray scale, and lack of operating stability.

Typically, in the process of cathode ray tube manufacture, the electron gun is installed in the glass cathode ray tube by inserting it into the neck of the tube, which is commonly flared. (The flared section is later removed). The forward end of the gun is centered in the neck by means of a plurality of contact or centering springs extending forwardly and outwardly from the upper or forwardmost electrode of the gun; that is, the electrode nearest the screen. This electrode is commonly termed the "convergence cup", or "support cup". The opposite end of the gun, that is, the rear end of the gun, is conventionally supported and centered in the neck of the tube by attachment of electrode electrical connections to a plurality of electrically conductive lead-in pins extending through a glass base of the tube. Joining of the glass base to the glass neck of the tube is accomplished by melting and joining the contiguous glass surfaces to provide a mechanical attachment and an air-tight seal. Thus, the electron gun is commonly supported within the neck of the cathode ray tube in two areas — at the forward end by the centering springs, and at the rear end by its attachment to the lead-in pins that extend through the glass base.

One deficiency of the prior art support system lies in the method commonly used to attach the electron gun assembly to the glass base, briefly alluded to above. The electron gun is comprised of a succession of components such as one or more cathodes, beam control electrodes, the beam-forming and beamfocusing electrodes of the main focus lens, and the support cup. As is well known in the art, these components, which collectively constitute the gun assembly, are mechanically fixed in proper relationship with each other in a rigid, coherent unit by a plurality of glass beads, or "pillars", that extend in a direction parallel to the center axis of the gun. In common practice, this gun assembly is in turn attached to the lead-in pins in the tube base by means of a plurality of stiff electrical wires which transmit operating power to cathode filaments, and electrical potentials to the beam-controlling, beam-forming and beam-focusing electrodes. (An example of the use of such wires is shown by FIG. 1 of U.S. Pat. No. 3,462,634). Each of these conductive wires must be cut to proper length and pre-formed into the proper configuration for interconnecting a lead-in pin and a gun electrode. While these wires are satisfactory as electrical conductors, they leave much to be desired in terms of providing firm mechanical support for the rear end of the electron gun. The resulting grid of supporting wires is inherently physically weak and vulnerable not only to shock and vibration, but also to distortion and twisting as a result of thermal cycling influences due to their propinquity to the cathode heater filaments. The wires may also flex in response to "memory" of their shape prior to forming, especially as aggravated by thermal cycling.

So the lower end of the gun is relatively unsupported and unstable, and deflection of the supporting electrical wires can cause abaxial and/or rotational misalignment, resulting too often in marked degradation of electron gun performance.

There is another drawback to the recited structure that relates to problems and costs of manufacture. The pre-formed wires must be installed by hand, with electrical attachment made by welding. Such labor-intensive methods are costly and can result in many rejects. Yields are further decreased by the fact that lead-in pins often have to be bent by pliers for proper mating with the pre-formed wires, with the result that the lead-in pin fillet may crack and the entire tube base will have to be discarded.

With regard to the prior art in electron gun mounting systems, it is known that a type of electrode support was provided in early radio receiving vacuum tubes that took the form of one or more internal mica discs positioned inside the tube envelope and near the base of the tube through which the lead-in pins passed. The purpose of these discs was to keep the electrical leads to the electrodes physically separated so as to prevent short circuits. No physical support of tube electrodes is ascribed to these mica spacers. No specific related prior art publications describing this application are known.

U.S. Pat. No. 3,716,739 discloses an annular electrically conductive support and shielding means for a compact electron gun. The structure is provided to avoid the use of the conventional glass beads. The support and shielding means is placed at the anode potential.

OTHER PRIOR ART

U.S. Pat. No. 3,394,279 — Yorns et al.

OBJECTS OF THE INVENTION

It is a general object of this invention to provide an improved structure for supporting electron guns in television receiver cathode ray tubes.

It is another object to provide improved structure for conducting voltages and currents from lead-in pins in the base of a television tube to an electron gun located within the neck of the tube.

It is a specific object to provide a supporting structure that establishes and maintains proper axial and rotational gun alignment.

It is another object of this invention to provide an improved support structure that serves the dual purpose of gun support together with the conduction of operating voltages to the gun electrodes.

It is still another object to provide supporting means that simplify gun assembly and reduce assembly costs.

It is yet another object of this invention to provide for shielding of the tube base from the effects of cathode sublimation which can result in arcing between lead-in pins.

BRIEF DESCRIPTION OF THE DRAWINGS

The features of the invention which are believed to be novel are set forth with particularity in the appended claims. The invention, together with further objects and advantages thereof, may best be understood, however, by reference to the following description taken in conjunction with the accompanying drawings, in the several figures of which like reference numerals identify like elements, and in which:

DESCRIPTION OF THE PREFERRED EMBODIMENT

This invention relates generally to electron guns used in television cathode ray tubes, and is specifically addressed to an improved gun support structure. The invention has applicability to guns of many types and constructions; for example, it is adaptable to single-beam electron guns used in black-and-white or index-type color television picture tubes, and, three-beam delta-configured or in-line color tube guns, both unitized. It is particularly applicable to three-beam electron guns for narrow-neck cathode ray tubes.

Figure 1:
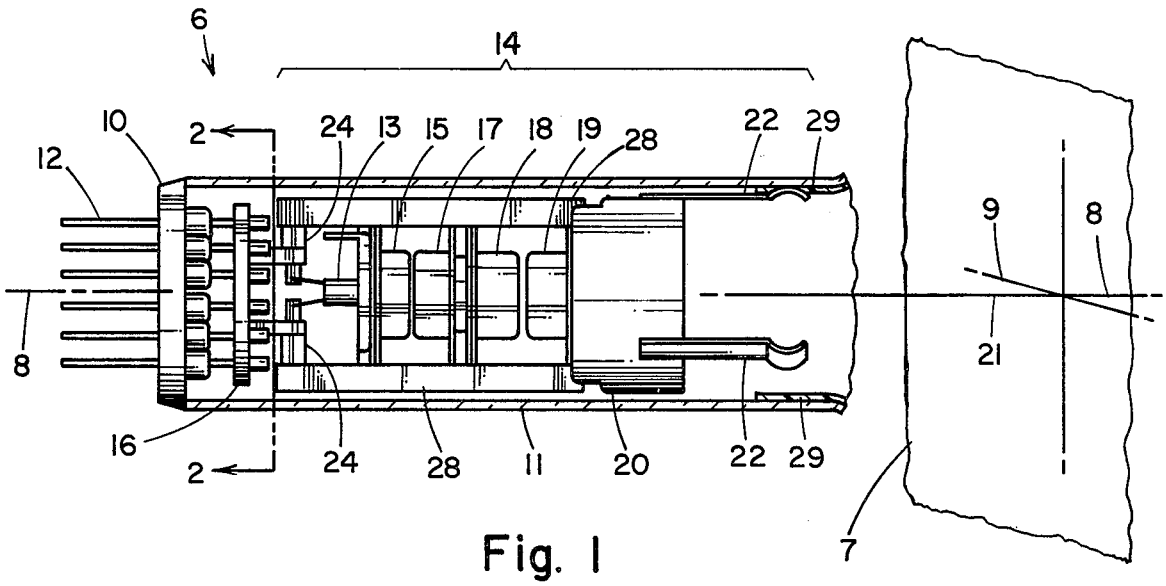
FIG. 1 is a side elevational view of a unitized, inline electron gun supported in the neck of a cathode ray tube by a gun support structure according to this invention; the viewing screen is drawn in perspective to show electron beam landing planes.

Whereas the invention can be embodied in several different forms, the preferred embodiments are illustrated in FIGS. 1–6, 8 and 9. FIG. 1 is a side elevational view of a three-beam unitized, in-line electron gun having an improved gun support structure in accordance with this invention.

As is well known in the art, an electron gun 14 for a cathode ray tube 6 (referring to FIG. 1) is located at the rear end of the tube, or cathode region, opposite the faceplate 7 and adjacent to the base 10 of the tube 6. The embodiment shown in FIG. 1 is a unitized, in-line type of gun that generates three coplanar electron beams, each of which is formed and directed to selectively energize color phosphor elements located on the imaging screen in the expanded area at the opposite end of the cathode ray tube 6. The center axis of gun 14 is in coincident alignment with the center axis 8 of tube 6. A predetermined horizontal scanning plane of the tube 6 is a plane including axis 8 and a line 9 parallel to the major axis of the (rectangular) faceplate 7 (shown in perspective).

A cathode ray tube neck 11 is terminated by the base 10. Base 10 has a plurality of electrical lead-in pins 12 for conducting into the cathode ray tube 6 voltages for formation of the television picture, including voltages applied to beam-forming and beam-focusing electrodes 15, 17, 18 and 19 of gun 14. These electrodes are supported as a coherent unit in spaced tandem succession along the gun's central axis 8 by a plurality of elongated, axially oriented structural beads 28.

An insulative gun support plate 16 is rigidly supported by a plurality of electrical lead-in pins 12 that enter the cathode ray tube neck 11 through base 10. The plate 16 constitutes an important aspect of this invention, as will be later described in detail.

Electron gun 14 is comprised of at least one cathode 13 for generating at least one electron beam 21. A support cup 20 is attached to electrode 19 of gun 14. Extending forwardly and outwardly from support cup 20 are centering springs, or "contact" springs 22, which serve to center the forward end of gun 14 in the neck 11 of cathode ray tube 6, and also act as electrical conductors between an electrically charged conductive coating 29 in the neck of the tube and electrode 19 of gun 14.

Figure 2:
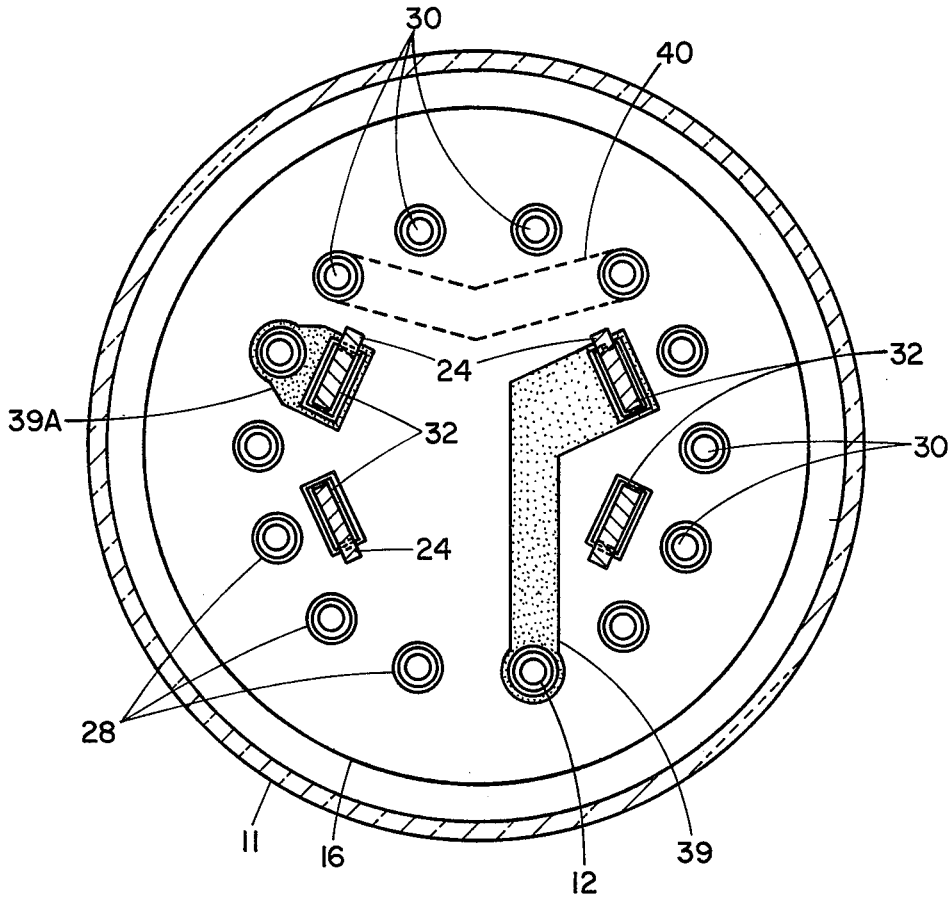
FIG. 2 is an enlarged elevational isolated view of the gun support plate taken along lines 2—2 of FIG. 1, showing printed electrical conductors on the plate.
Figure 3:
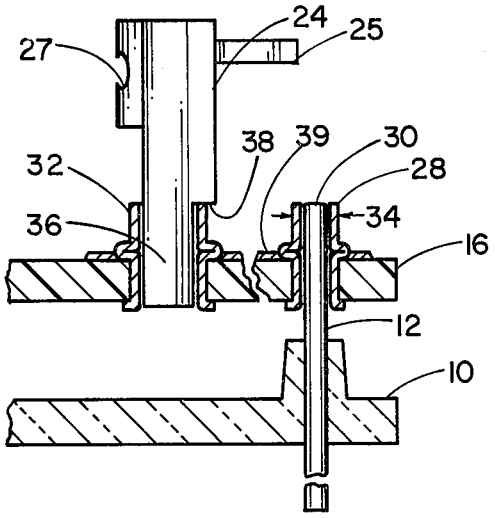
FIG. 3 is a partial side view in section of a gun support structure including a section of the tube base, a lead-in pin, the gun support plate and a gun support standard.

Reference is now made to FIGS. 2 and 3 which, in conjunction with FIG. 1, show further structural details. In accordance with this invention, the rear end (cathode end) of electron gun 14 is supported and centered by gun support plate 16 through (in this embodiment) the medium of a plurality of gun support standards 24. One end of each of these standards 24 is inserted into an eyelet 32, preferably of non-circular (here rectangular) cross-section, inserted into an aperture in plate 16. Each eyelet 32 is permanently fastened to plate 16 by standard eyelet clinching means, or by brazing.

The opposite end of each standard 24 has a claw 27 for embedment in one of the structural beads 26 which serve to space and to provide mechanical support for the electrodes of gun 14.

Referring to FIG. 2, plate 16, which may be circular, is comprised of an electrically insulative material such as a ceramic. The plate has therein a circular array of apertures through which are inserted circular eyelets 28, which are clinched or brazed in permanent attachment to plate 16. Each eyelet 28 has in turn a hole therethrough for the passage of electrical lead-in pins 12 that project entirely through plate 16. The protruding tips of the pins 12 are shown by 30 in FIG. 2.

Further structural details are shown by FIG. 3. The plurality of lead-in pins 12 (one of which is shown) which pass through base 10 are bonded to the glass of base 10 by conventional glass-to-metal sealing means. Pins 12 and plate 16 are in turn permanently bonded together by means such as welding through the side walls (e.g., at about point 34) of circular eyelet 28, thus providing for rigid support of plate 16 by the plurality of pins 12.

Similarly, one end of each standard 24 is inserted into an eyelet 32, coming to rest at a stop 38 provided on the standard 24. Standard 24 is permanently bonded to eyelet 32 by means such as welding through the side wall of eyelet 32 at a point such as point 36. The described structure according to this invention thus provides a rigid and stable support for the gun by means of the standards 24 which are rigidly affixed to plate 16 which in turn is rigidly supported by pins 12 affixed to base 10.

Figure 4:
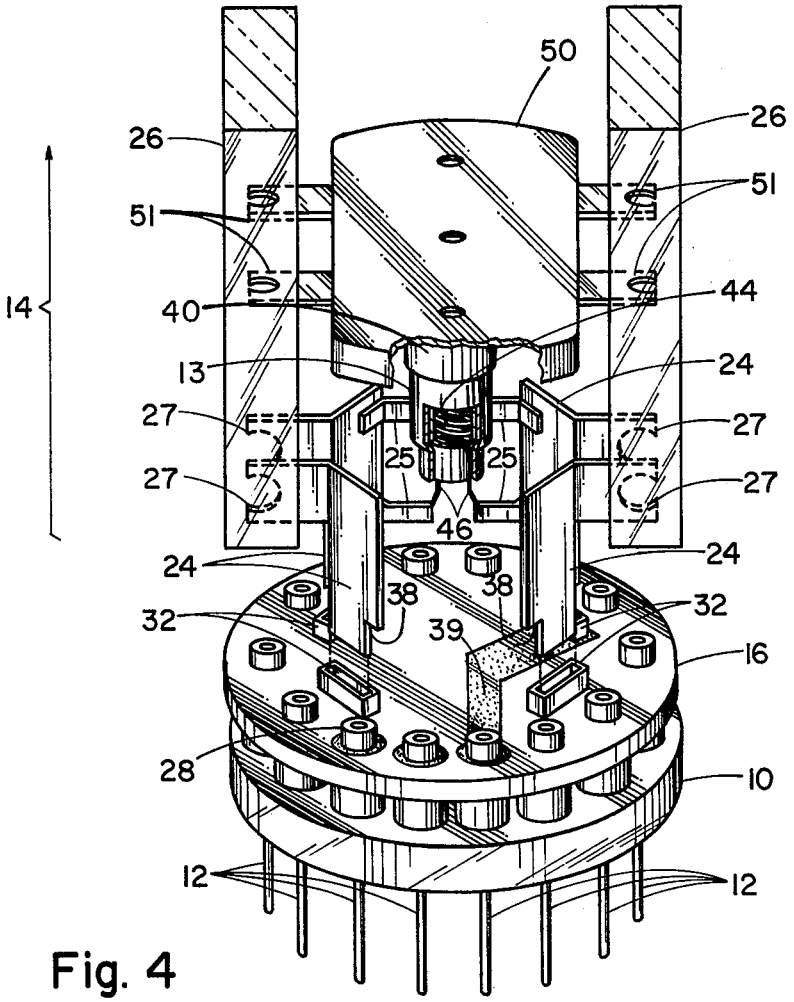
FIG. 4 is a partial view, exploded, in perspective and partially in phantom showing the relationship of the base and lead-in pins, the gun support plate, gun support standards, structural heads, cathode heater filaments, a cathode, and a first grid.

Turning now to FIG. 4, this partial view in perspective shows the inter-relationship between base 10, plate 16, standards 24, electron gun 14, and the axially oriented structural beads 26. FIG. 4 also shows the method of assembly of all components of the mounting system in relation to gun 14. As shown by the Figure, during the standard beading process, the claws 27 of each standard 24 are embedded in beads 26. The standards 24 (here four in number) are properly aligned during the assembly process prior to beading by fixtures which hold standards 24 so that the gun assembly 14, with the four standards projecting therefrom, can be inserted into the four rectangular eyelets 32, as indicated by the dashed lines between standards 24 and rectangular eyelets 32. This male-female relationship of standards and eyelet socket structure simplifies gun assembly during manufacture in that quick-mounting of gun 14 to plate 16 is a simple matter of "plugging in" the standards 24 extending from gun 14 into the rectangular eyelets 32 mounted in gun support plate 16. It is seen that by this novel assembly method, the eyelets 32 act as socket components. In this embodiment the standards 24 are the male components, the eyelets 32 the female components. Their genders could as well be reversed, however.

Following insertion, standards 24, and thus the assembled gun 14, are then rigidly affixed to the support plate 16 as by welding through the side walls of rectangular eyelets 32 at points indicated by 36, as described. By this means and method, there is promoted the coincident alignment of gun 14 with a central axis 8 of the cathode ray tube 6. Also, the proper rotational alignment of the gun relative to a predetermined horizontal scanning plane 9 of the tube is enhanced. For the three-beam in-line gun cited in this disclosure, rotational alignment approaching or exceeding ± 0° 30 minutes can be achieved.

The complete method for quick-mounting an electron gun and assembling the gun into the cathode ray tube is as follows —

1. Rigidly supporting a plurality of beam controlling and focusing electrodes as a coherent unit in spaced tandem succession along the gun central axis by embedding claws projecting from the electrodes into a plurality of elongated, axially oriented structural beads softened by heat, concurrently with the embedding of the claws of the gun support standards into the beads; 2. Providing a tube base having therethrough a plurality of electrical lead-in pins to transmit voltages to said electrodes; 3. Affixing to the lead-in pins a gun support plate having a gun-mounting socket component designed to conjoin in a male-female relationship with the gun support standards serving as a mating socket component on the gun; 4. Plugging the socket components of the gun and gun support plate together; and 5. Inserting the gun into the neck of the tube and hermetically sealing the base to the tube neck.

The mounting means described in the foregoing provides another essential function, and that is electrical interconnection between pins 12 and the several electrodes of gun 14. Referring again to FIG. 2, a pattern of electrical conductors 39, 39A and 40 (on the rear side) are shown as printed on insulative support plate 16 to provide for electrical interconnection in the following sequence — through pin 12, through circular eyelet 34, through printed-on electrical interconnections 39 and to rectangular eyelet 32. The pattern of electrical conductors printed on gun support plate 16 depends upon the electrical routing requirement necessary for tube operation. Electrical interconnection 39, for example, is a relatively long connection, while electrical interconnection 39A is relatively short.

Figure 5:
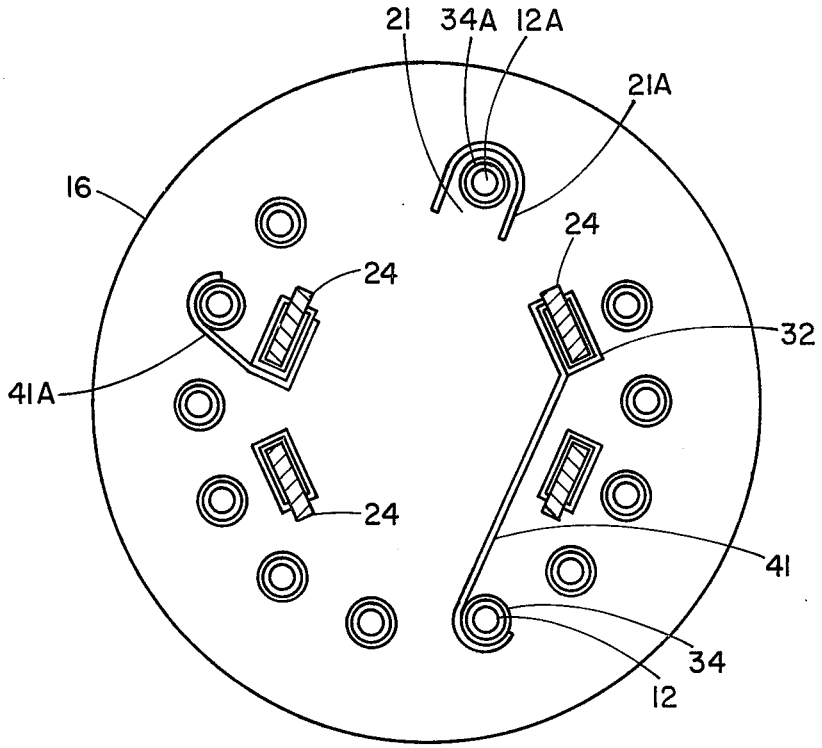
FIG. 5 is an enlarged elevational isolated view corresponding to FIG. 2, but representing an alternative embodiment of one aspect of the invention.
Figure 6:
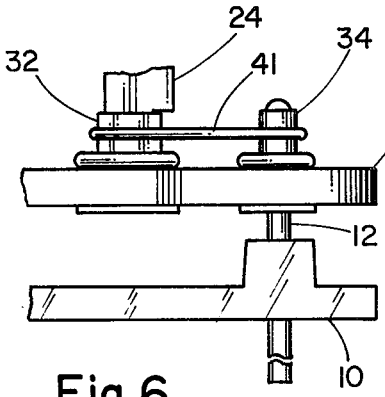
FIG. 6 is an enlarged, fragmentary side view of the assembly shown by FIG. 5.

Electrical interconnections can also be made by means other than printing, as shown by FIGS. 5 and 6. In this aspect of the invention, electrical interconnection between pin 12, circular eyelet 34 and rectangular eyelet 32 is provided by an electrically conductive wire or band 41 wrapped around eyelets 32 and 34, with electrically conductive contact made by welding. Conductive wire or band 41A is an example of a shorter interconnection between close-lying parts.

The electron gun described in this disclosure requires for operation a plurality of high voltages which are conducted into the tube neck 11 through pins 12 passing through base 10. These voltages are of the order of several kilovolts. Voltages of such magnitude are ordinarily difficult to conduct in the confines of a narrow-necked tube without arcing. To prevent arcing, plate 16 has formed therethrough a gap 21A located, when the plate is assembled, between at least two of the lead-in pins 12 to prevent arcing therebetween. In the illustrated preferred embodiment, the gap 21A has a "U" shape, and isolates high-voltage lead-in pin 12A (referring to FIG. 5) and its associated circular eyelet 34A.

Turning again to FIG. 4, the final links in the electrical connection between pins 12 and the electrodes of gun 14 are shown. In foregoing paragraphs, the electrical interconnection between pins 12 and rectangular eyelets 32 is described as being through conductors 39, 39A and 40 printed on plate 16, or by electrically conductive wrap-around bands or wires 41 and 41A. The standards 24 are preferably also electrically conductive, so the standards not only provide mechanical attachment and support for assembled gun 14 but preferably also serve as electrical conductors for several or all of the electrodes of gun 14. In FIG. 4, for example, two standards 24 are shown as conducting filament current to the cathode heater filament 44 that lies within cathode 13.

Associated first grid 50 is shown in relationship to cathode 40. As shown, first grid 50 is held in permanent and proper alignment in relationship to all other electrodes of gun 14 by the fact that it has at least one pair of widely spaced, relatively narrow claws 27 embedded at widely spaced points on wide beads 26, and inserted into the glass of bead 26 during the beading process. This structural concept does not constitute per se an aspect of this invention but is described and claimed in referent U.S. Pat. No. 4,032,811.

Electrical connection to cathode heater 44 is accomplished in this example by connecting heater leads 46 to tabs 25 extending from two standards 24. Thus an electrically conductive path is provided from external voltage sources through, successively, pins 12, printed electrical conductive path 39, a standard 24 and its extending tabs 25, which in turn are connected to heater legs 46 to energize heater filament 44. In the example shown, two standards 24 conduct heater power to at least one cathode heater. By simple parallel or series interconnection, the same two standards can supply power to the filaments of more than one cathode; for example, three cathodes in the case of the illustrated three-beam unitized, in-line gun. The other two standards 24 can be used to conduct other voltages such as focus voltages for operation of focus electrodes 15, 16 and/or 17, or video drive signals.

Figure 7:
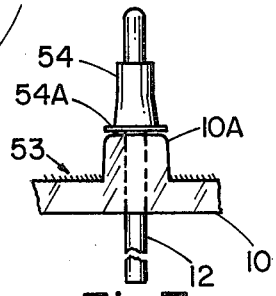
Fig. 7 PRIOR ART
FIG. 7 is a side view of a base and lead-in pin assembly showing a prior art stem eyelet shield.

The use of a gun support plate makes possible the elimination of a certain component otherwise required for shielding the base 10 of tube 6 and the lead-in pins from the effects of cathode sublimation. Referring now to FIG. 7, such sublimation takes the form of metallic vapors evaporated from the nearby cathodes which deposit an electrically conductive coating 53 on base 10. This coating serves as a path to initiate arcing between adjacent pins. To restrict such deposition and to interrupt potential arcing paths, it is common in the prior art to use a stem eyelet shield 54 that encircles pin 12 just above fillet 10A of base 10. The skirt 54A of shield 54 prevents deposition of conductive coating 53 onto fillet 10A, interrupting the growth of conductive coating 53 into the pin area. Such stem eyelet shields are not required when a gun support plate is used in that the plate, which lies between the electron gun and the base, acts to shield the base from the deposition of arc-inducing conductive metallic vapors sublimed by the cathodes.

Figure 8:
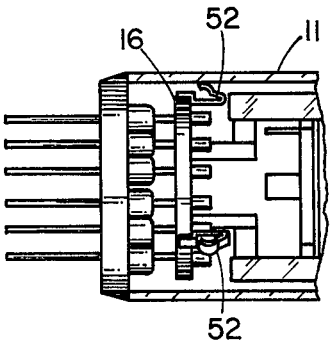
FIG. 8 is a partial side elevational view of an electron gun having a gun support plate according to this invention on which are mounted centering springs.

Another feature of the preferred embodiment of this invention is shown by FIG. 8. The forward end of an electron gun, that is, the end nearest the cathode ray tube screen, is commonly centered in the neck 11 of the tube by a plurality of centering springs 22. These are shown by FIG. 1, reference 22. The opposite end, or lower end, of the electron gun has no such centering means; centering is usually accomplished by fixturing means as the gun is inserted into the tube neck during the assembly process. The provision of plate 16, however, makes possible during junction of the base 10 and neck 11 the centering of the lower end of the gun in neck 11 in the same manner as it is done in the forward end; that is, by means of centering springs. As shown by FIG. 8, plate 16 has projecting from it a plurality of centering springs 52. By virtue of the fact that the springs 52 exert equalized outward pressure against the inner walls of neck 11 of the cathode ray tube, the rear end of the gun is effectively centered within the neck at the base area. The utilization of this means for centering the tube during the assembly process simplifies manufacture.

Figure 9:
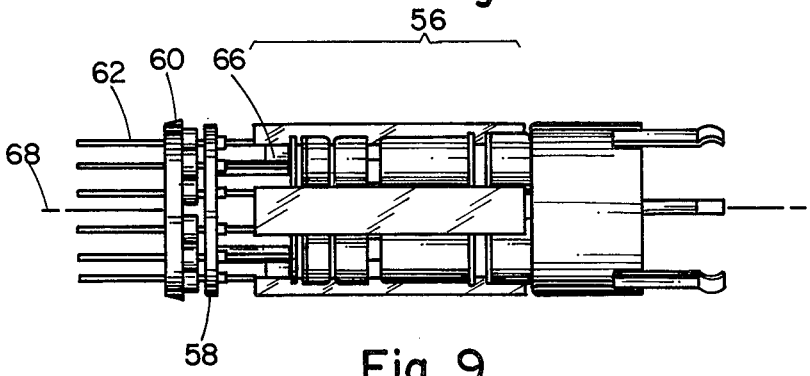
FIG. 9 is a side elevational view of a delta-configured electron gun having a gun support structure according to this invention.

The invention has application to electron guns of many different types and constructions. As an example, FIG. 9 is a side elevation view of a delta-configured gun 56 having a gun support plate 58 rigidly supported between electron gun 56 and the tube base 60. Lead-in pins 62 conduct signal voltages and operating voltages and current into the tube envelope. The pins 62, projecting through a circular array of eyelets and welded thereto, rigidly support a circular gun support plate 58 in close adjacency to base 60 as heretofore described. Also as described, at least one gun support standard 66 (preferably a plurality) rigidly supports gun 56 in coincident alignment with a central axis 68 of the cathode ray tube, and in rotational alignment relative to a predetermined horizontal scanning plane parallel to the major axis of the rectangular faceplate.

With regard to exemplary specifications, the diameter of gun support plate 16 is nominally 0.80 inch and its thickness is 0.55 inch. The plate, with apertures for the circular eyelets and the rectangular eyelets, can be formed from a high-strength ceramic material. Electrical resistivity is a necessary property; this property must be compatible with a fairly high compressive strength to resist fracturing as a result of the eyelet insertion and crimping process. Also, since the plate is located close to the cathodes, the ceramic must tolerate stress induced by repeated thermal cycling. The surface of the ceramic must also accept printed electrical conductors, and it must accept brazing compounds as an alternate means of assembly. Standards 24 are preferably formed by die-punching from type 305 stainless steel of a thickness of 0.015 inch, for example.

Other changes may be made in the above-described apparatus without departing from the true spirit and scope of the invention herein involved, and it is intended that the subject matter of the above depiction shall be interpreted as illustrative and not in a limiting sense.

I claim:

1. For use in a television cathode ray tube having a neck terminated by a base, and including adjacent to the base an electron gun having at least one cathode for generating at least one electron beam and having beam focusing electrodes supported as a coherent unit in spaced tandem succession along the gun's central axis by a plurality of elongated, axially oriented structural beads, with said base having therethrough a plurality of electrical lead-in pins to convey applied operating voltages to said cathode and electrodes, said gun having a gun support plate rigidly supported closely adjacent to said base by said lead-in pins, the combination including quick-mount gun mounting means for rapidly and rigidly interconnecting said gun and said support plate, said quick-mount mounting means including male-female socket components, said gun having one socket component including means embedded in at least one of said beads, said plate having means defining the other socket component said socket component for said gun comprising a support standard having a portion transverse to said central axis embedded in said bead, and a portion parallel to said axis which cooperates with said means defining said other socket component in said plate, said socket components providing for facile and secure plugging together of said gun and said base, and wherein said combination includes electrically conductive means connected between at least one of said lead-in pins and one of said electrodes, said male-female socket components providing also for the facile and secure plugging together of electrical conductive paths between one of said electrical lead-in pins and one of said electrodes to transmit electrical voltages or currents therebetween, and wherein one of said electrically conductive paths comprises a printed electrical conductor on said gun support plate between said lead-in pin and said socket components.

* * * * *